US007143986B1

(12) United States Patent
Austin et al.

(10) Patent No.: US 7,143,986 B1
(45) Date of Patent: Dec. 5, 2006

(54) STABILIZING DEVICE

(76) Inventors: Delbert L. Austin, 9840 W. Bath Rd., Laingsburg, MI (US) 48848; Rodney Austin, 9853 E. Price Rd., Laingsburg, MI (US) 48848

( * ) Notice: Subject to any disclaimer, the term of this patent is extended or adjusted under 35 U.S.C. 154(b) by 91 days.

(21) Appl. No.: 10/804,794

(22) Filed: Mar. 19, 2004

Related U.S. Application Data

(60) Provisional application No. 60/456,219, filed on Mar. 20, 2003.

(51) Int. Cl.
*F16M 11/04* (2006.01)

(52) U.S. Cl. ..... 248/187.1; 248/177.1; 248/176.1; 248/127; 248/158; 248/560; 248/562; 248/125.8; 40/71.01; 89/37.01

(58) Field of Classification Search ..... 248/187.1, 248/177.1, 176.1, 127, 158, 560, 562, 125.8, 248/188, 163.1; 40/71.01; 89/37.01
See application file for complete search history.

(56) References Cited

U.S. PATENT DOCUMENTS 1,295,688 A * 2/1919 Butler ..... 42/94
1,890,423 A * 12/1932 Teagarden ..... 42/94
2,436,349 A * 2/1948 Adams ..... 42/94
2,991,579 A * 7/1961 Lies ..... 42/94
3,327,422 A * 6/1967 Harris ..... 42/94
3,703,046 A * 11/1972 Barone et al. ..... 42/94
4,017,997 A * 4/1977 Peterson et al. ..... 42/94
4,470,216 A * 9/1984 Harris ..... 42/85
4,625,620 A * 12/1986 Harris ..... 89/37.04
4,641,451 A * 2/1987 Harris ..... 42/85
4,787,290 A * 11/1988 Argon ..... 89/37.05
4,903,425 A * 2/1990 Harris ..... 42/94
5,454,473 A * 10/1995 Hennessey ..... 211/85.6
5,711,103 A * 1/1998 Keng ..... 42/94
6,412,737 B1 * 7/2002 Minagawa ..... 248/166
6,912,945 B1 * 7/2005 Ang ..... 89/37.05
2002/0088448 A1 7/2002 Sims

* cited by examiner

*Primary Examiner*—Richard E. Chilcot, Jr.
*Assistant Examiner*—Todd M. Epps
(74) *Attorney, Agent, or Firm*—Ian C. McLeod

(57) ABSTRACT

A stabilizing device for reducing or eliminating the vibration in an object to allow for easier and more accurate operation of the object. The stabilizing device includes an object bracket, legs, side arms and front arms. The legs and arms move the vibrations away from the object bracket and the object and eliminate or reduce the vibrations. The legs and arms include a core surrounded by damping material. The damping characteristics of the legs, side arms and front arms can be adjusted by selecting damping material having different damping characteristics depending on the type of object to be used with the stabilizing device and the type of vibrations to be reduced or eliminated.

57 Claims, 7 Drawing Sheets

STABILIZING DEVICE

CROSS-REFERENCE TO RELATED APPLICATION

This application claims the benefit of provisional Application Ser. No. 60/456,219, filed Mar. 20, 2003.

STATEMENT REGARDING FEDERALLY SPONSORED RESEARCH OR DEVELOPMENT

Not Applicable

BACKGROUND OF THE INVENTION (1) Field of the Invention

The present invention relates to a stabilizing device for reducing the vibration in an object positioned on a surface. In particular, the present invention relates to a stabilizing device which reduces the vibration of a firearm caused by the movement or vibration of the surface on which the firearm is positioned.

(2) Description of the Related Art

In today's conflicts, to be effective, a shooter must be able to accurately shoot from a variety of environments whether moving or stationary. However, in the past, a shooter was unable to accurately align the firearm with the target and maintain the alignment when the firearm was resting on a vibrating surface. The vibration of the surface was transferred from the surface to the firearm causing the firearm to vibrate even when the firearm was positioned on a bipod or tripod. The same problem occurs when other objects such as a camera are operated while positioned on a vibrating surface.

There remains a need for a stabilizing device which dampens vibrations in a variety of different directions to reduce the vibrations in the object transferred from a vibrating surface to the object positioned on the surface.

SUMMARY OF THE INVENTION

The present invention relates to a stabilizing device for reducing or eliminating the vibration in an object to allow for easier and more accurate operation of the object. In one (1) embodiment, the stabilizing device reduces vibration in the object caused by the positioning of the object on a vibrating surface. In another embodiment, the stabilizing device reduces vibration in the object caused by operation of the object. The stabilizing device includes an object bracket, legs, side arms and front arms. The legs and arms move the vibrations away from the object bracket and the object and eliminate or reduce the vibrations. The object is intended to be secured to the top side of the object bracket. In one (1) embodiment, a top plate is pivotably secured to the top side of the object bracket and the object is secured to the top plate. The top plate allows for additional positioning of the object after the stabilizing device is positioned on the ground. The legs extend outward from the object bracket and are intended to be positioned on the vibrating surface. The legs can be pivotably connected to the object bracket to enable the legs to be moved into a folded position when the stabilizing device is not in use. In one (1) embodiment, the longitudinal axes of the legs are perpendicular to the longitudinal axis of the object bracket and the object. The side arms are mounted on the object bracket and extend outward from the object bracket essentially perpendicular to the longitudinal axis of the object bracket and the object. The front arms are mounted on the front of the mounting bracket so that the longitudinal axes of the front arms are parallel to the longitudinal axis of the object bracket and the object. In the embodiment where the object is secured to a pivotable top plate, the front arms are also connected to the pivotable top plate. The legs include a core surrounded by damping material. The legs can be constructed from a variety of similar or different damping units. The damping units are preferably interchangeable so that the types of damping units can be varied depending on the object and the vibration to be damped. The side arms also have a core surrounded by damping material. The side arms could be constructed of a single damping unit. The front arms also include a center rod surrounded by damping material. The damping material of the front arms is spaced in front of the bracket. The damping characteristics of the front arms could be accomplished by a single damping unit. The damping characteristics of the legs, side arms and front arms can be adjusted by selecting damping material having different damping characteristics depending on the type of object to be used with the stabilizing device and the type of vibrations to be reduced or eliminated.

The present invention relates to a stabilizing device for damping vibrations in an object positioned on a surface, which comprises: a bracket configured to connect to the object; legs, each leg having a first end and a second end with first damping material between the ends and connected at the first end to the bracket; and side arms each having a first end and a second end with second damping material between the ends and connected at the first end to the bracket.

Further, the present invention relates to a stabilizing device for damping vibrations in a firearm positioned on a surface, which comprises: a bracket configured to connect to the firearm; legs, each leg having a first end and a second end with first damping material between the ends and connected at the first end to the bracket; and side arms each having a first end and a second end with second damping material between the ends and connected at the first end to the bracket.

Still further, the present invention relates to a stabilizing device for damping vibrations in a firearm positioned on a surface, which comprises: a bracket configured to connect to the firearm; legs, each leg having a first end and a second end with the first end of each leg connected to the bracket, each leg having first damping material between the ends; and a forward arm having a first end and a second end forming a longitudinal axis of the forward arm with the first end of the forward arm connected to the bracket and having second damping material between the ends.

Further still, the present invention relates to a stabilizing device for damping vibrations in a firearm positioned on a surface, which comprises: a bracket configured to connect to the firearm; legs, each leg having a first end and a second end and connected at the first end to the bracket, each leg having first damping material between the ends; side arms, each arm having a first end and a second end and connected at the first end to the bracket, each side arm having second damping material between the ends; and a forward arm having a first end and a second end and connected at the first end to the bracket and having third damping material between the ends.

Further, the present invention relates to a stabilizing device for damping vibrations in a firearm positioned on a surface, which comprises: a bracket configured to connect to the firearm; a leg having a first end and a second end forming a longitudinal axis of the leg with the first end of the leg connected to a center of the bracket, the leg having first damping material between the ends; side arms, each side arm having a first end and a second end with the first end of each side arm connected to the bracket and each side arm having second damping material between the ends; and a forward arm having a first end and a second end and connected at the first end to the bracket and having third damping material between the ends.

Still further, the present invention relates to a method for reducing vibration in a firearm positioned on a surface, which comprises the steps of: providing a stabilizing device including a bracket, legs having a first damping material connected to the bracket and side arms having second damping material connected to the bracket; connecting the firearm to the bracket; positioning the legs of the bracket on the surface; aligning the firearm with a target; and pulling a trigger of the firearm to hit the target wherein the stabilizing device reduces the vibration of the firearm to enable a more accurate shot.

Further still, the present invention relates to a method for reducing vibrations of a firearm positioned on a surface, which comprises the steps of: providing a stabilizing device including a bracket, legs connected to the bracket having first damping material, side arms connected to the bracket having second damping material and a forward arm connected to the bracket having third damping material; connecting the firearm on the bracket; positioning the legs of the stabilizing device on the surface; aligning the firearm with a target; and pulling a trigger of the firearm to shoot the target wherein the stabilizing device reduces vibration in the firearm to allow for a more accurate shot.

Finally, the present invention relates to a method for reducing vibration in an object positioned on a surface, which comprises the steps of: providing a stabilizing device including a bracket, legs having a first damping material connected to the bracket and side arms having second damping material connected to the bracket; connecting the object to the bracket; positioning the legs of the bracket on the surface; aligning the object with a target; and operating the object wherein the stabilizing device reduces the vibration in the object to enable a more accurate operation of the object.

The substance and advantages of the present invention will become increasingly apparent by reference to the following drawings and the description.

BRIEF DESCRIPTION OF THE PREFERRED EMBODIMENTS

Figure 1:
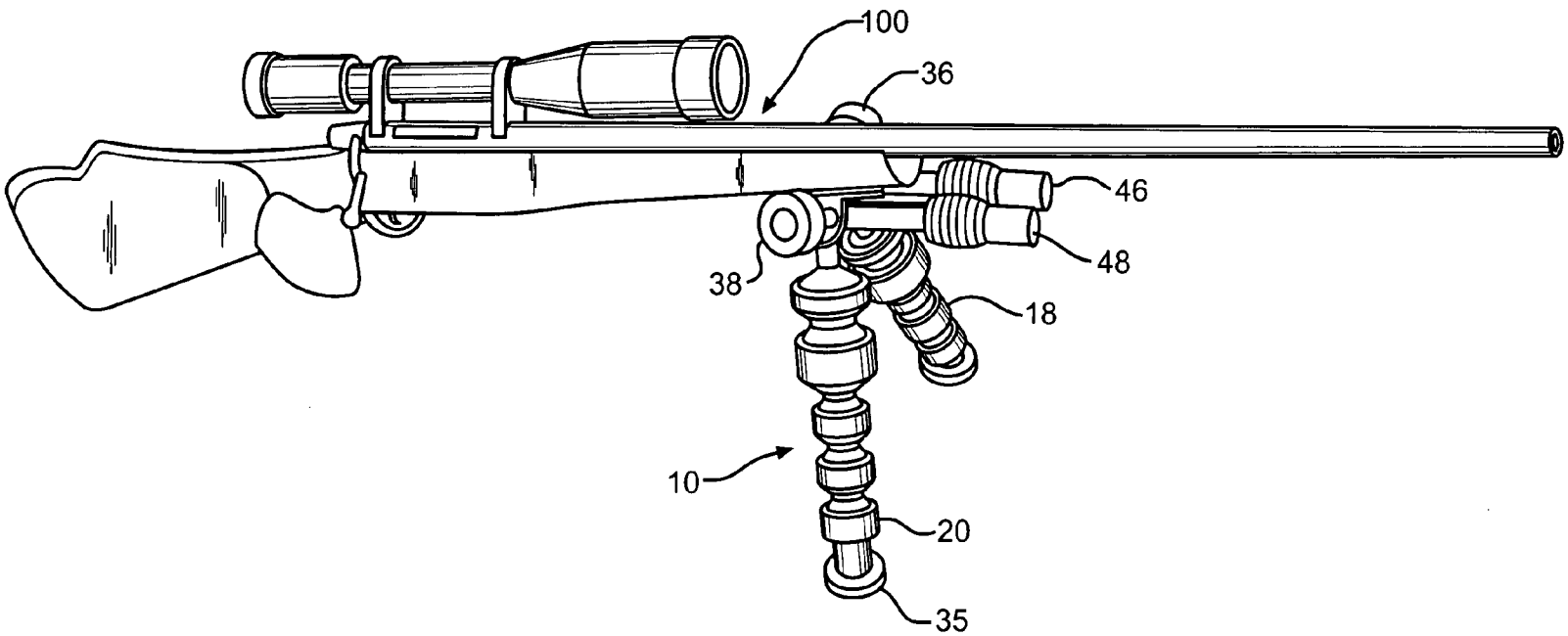
FIG. 1 is a perspective view of the stabilizing device 10 of the present invention.
Figure 2:
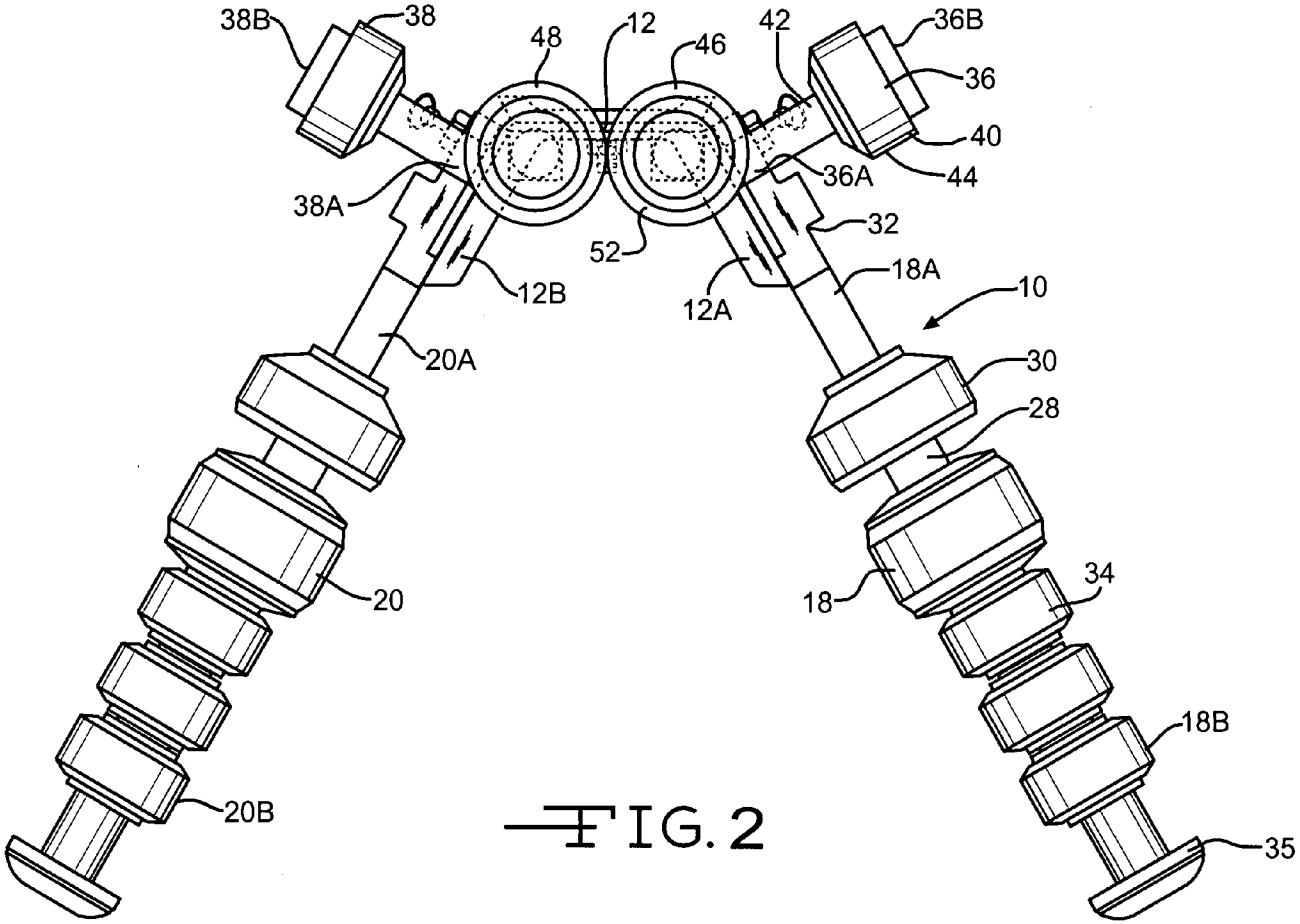
FIG. 2 is a front view of the stabilizing device 10.
Figure 3:
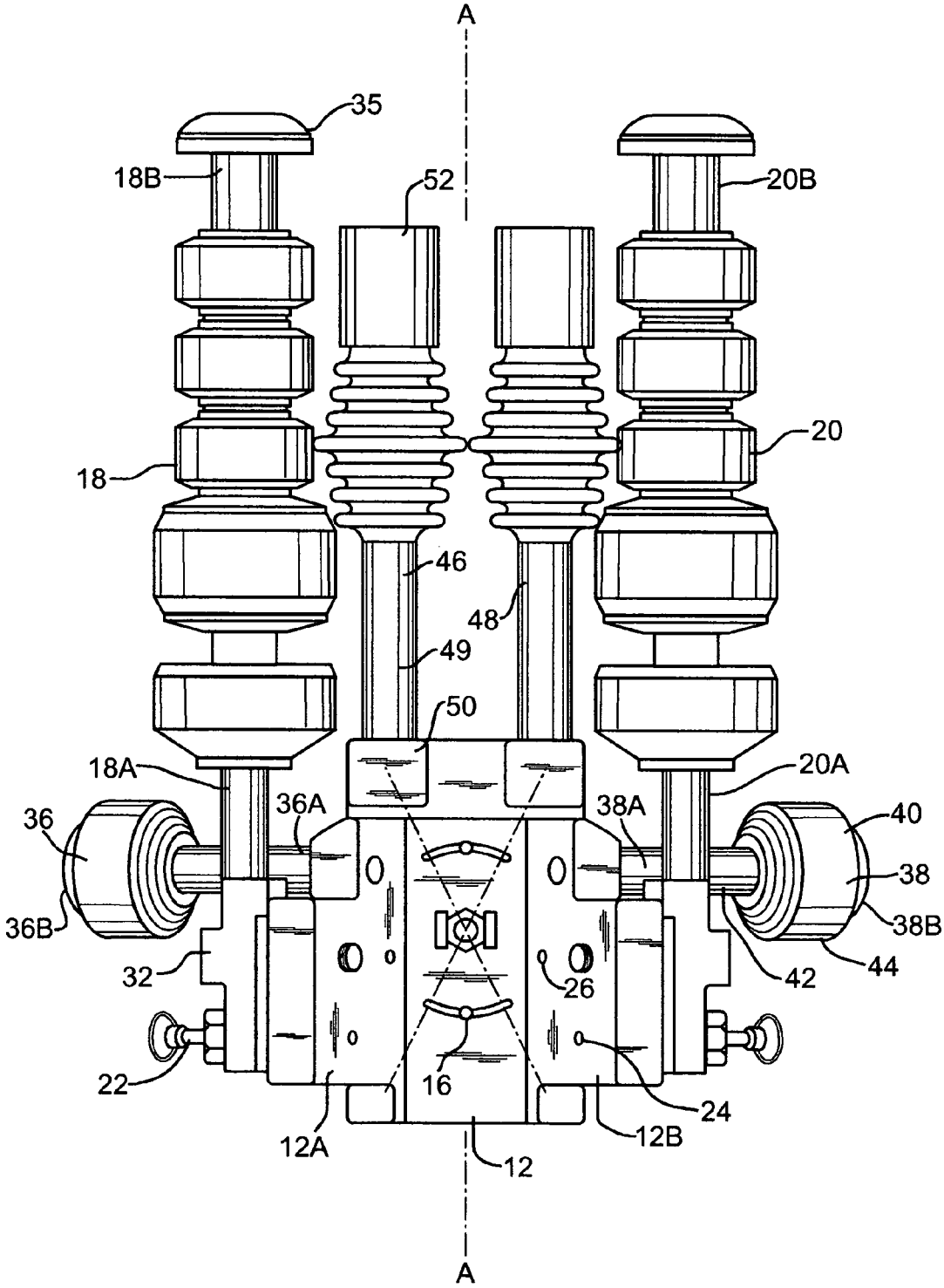
FIG. 3 is a bottom view of the stabilizing device 10 with the legs 18 and 20 in the folded position and showing the pivoting movement of the top plate 14 of the object bracket 12.
Figure 4:
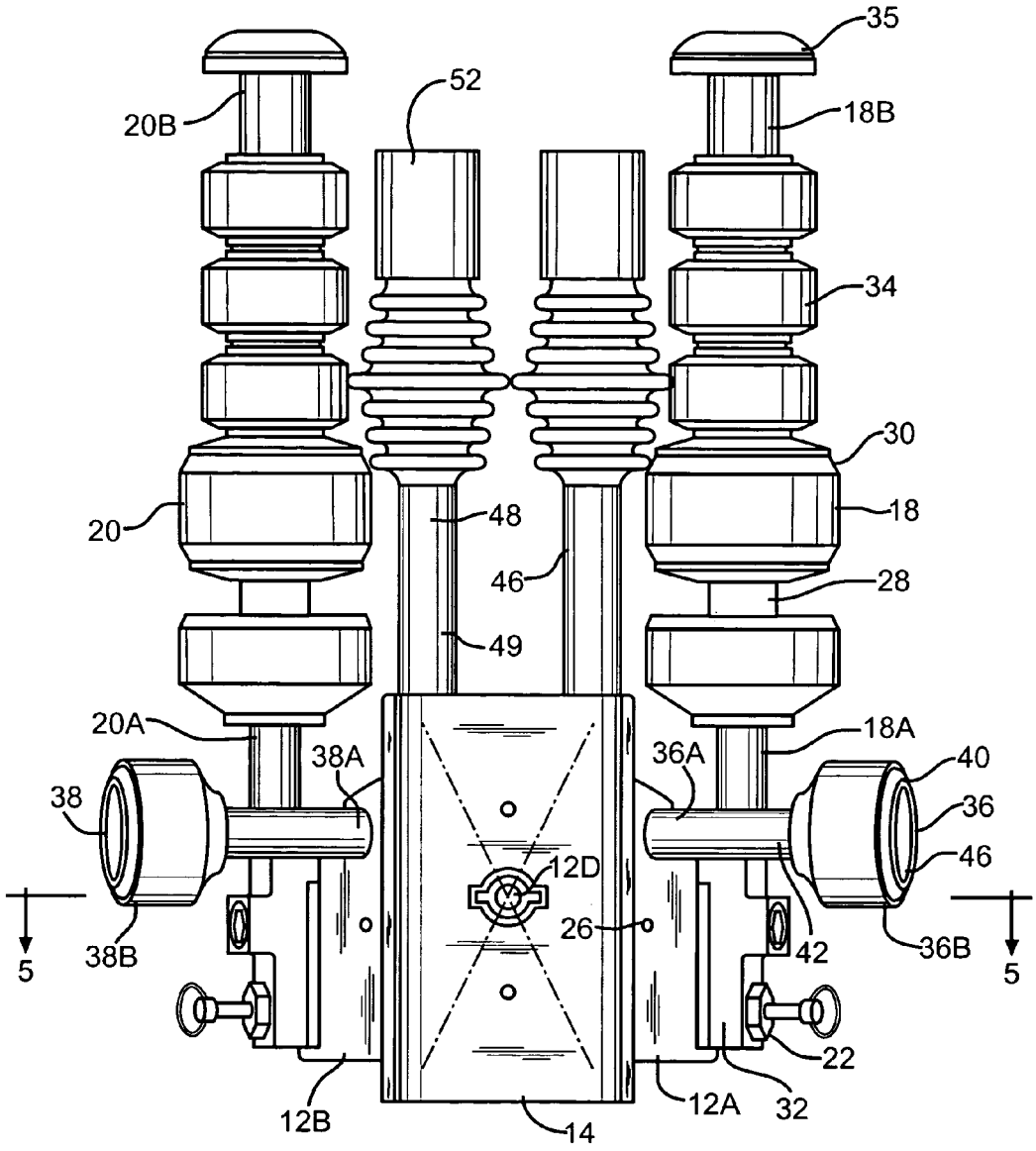
FIG. 4 is a top view of the stabilizing device 10 with the legs 18 and 20 in the folded position.
Figure 5:
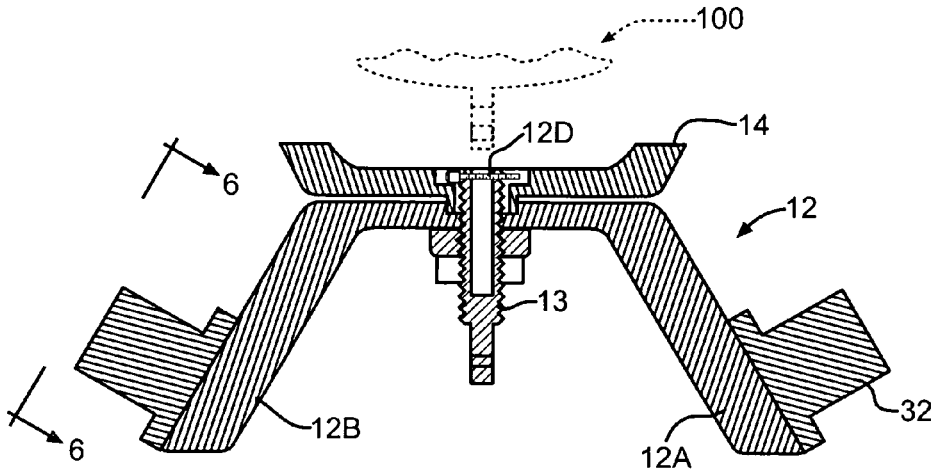
FIG. 5 is a partial cross-sectional view of the object bracket 12 showing the object bracket 12 and the top plate 14.

FIGS. 1 to 4 show the stabilizing device 10 of the present invention. The stabilizing device 10 includes an object bracket 12, legs 18 and 20, side arms 36 and 38 and front or forward arms 46 and 48. The object bracket 12 is positioned between the legs 18 and 20, side arms 36 and 38 and front arms 46 and 48 so that when the object 100 is mounted on the object bracket 12, the object 100 is positioned between the legs 18 and 20 and side arms 36 and 38. In one (1) embodiment, the bracket 12 has a pair of legs 12A and 12B mounted together at an angle to a center section 12C. In one (1) embodiment, a top plate 14 is pivotably mounted on the top side of the center section 12C of the bracket 12 such as to allow the object 100 connected to the top plate 14 to pivot while the object bracket 12 remains stationary (FIGS. 3 and 4). It is understood that the top plate 14 can be pivotably mounted on the center section 12C by any well known means. The top plate 14 can be pivotably connected to the center section 12C by a center pivot point. In one (1) embodiment, the top plate 14 is able to pivot approximately 25° in either direction from the longitudinal or horizontal axis A—A of the object bracket 12 (FIGS. 3 and 4). The bottom side of the top plate 14 can be provided with guide pins 16 which extend into curved slots in the center section 12C of the object bracket 12 and which help secure the top plate 14 to the center section 12C of the object bracket 12. The shape of the center section 12C of the object bracket 12 or the top plate 14 depends on the object 100 to be connected to the stabilizing device 10. In one (1) embodiment, the object 100 is a firearm and the top side of the top plate 14 has a rectangular shape with a longitudinal channel extending between the ends along the axis A—A. The longitudinal channel allows for connecting the stock of the firearm 100 to the object bracket 12. In this embodiment, the firearm is connected to the object bracket 12 by a pin 22 which extends downward from the stock of the firearm. The pin 22 extends into an opening 12D in the object bracket 12. In one (1) embodiment, the opening 12D is in the connector pin 13 of the object bracket 12 which secures the top plate 14 to the object bracket 12. The connector pin 13 has a center bore into which the pin 13 extends. The connector pin 13 also assists in securing the top plate 14 to the object bracket 12. In one (1) embodiment, the connector pin 13 is in the center of the center section 12C of the object bracket 12.

Figure 6:
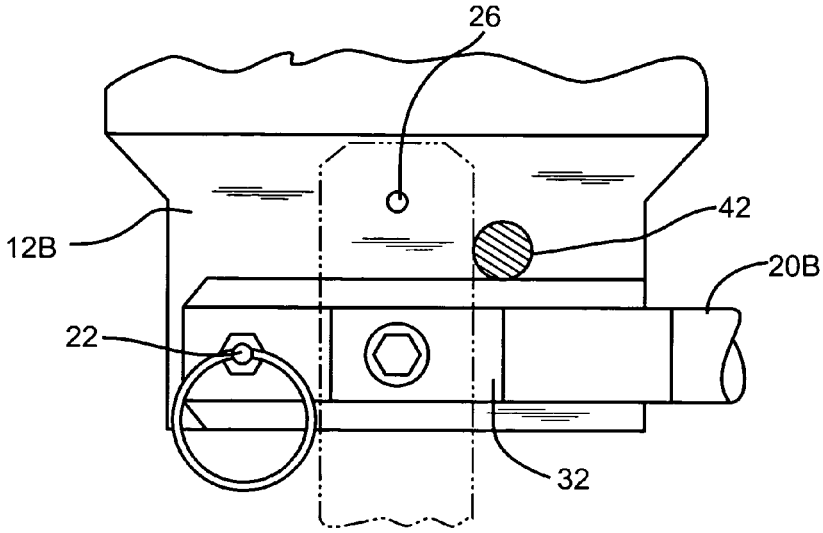
FIG. 6 is a partial side view along the line 6—6 of FIG. 5 showing the left leg 20 in the folded position and showing the left leg 20 in the extended position in phantom.
Figure 7:
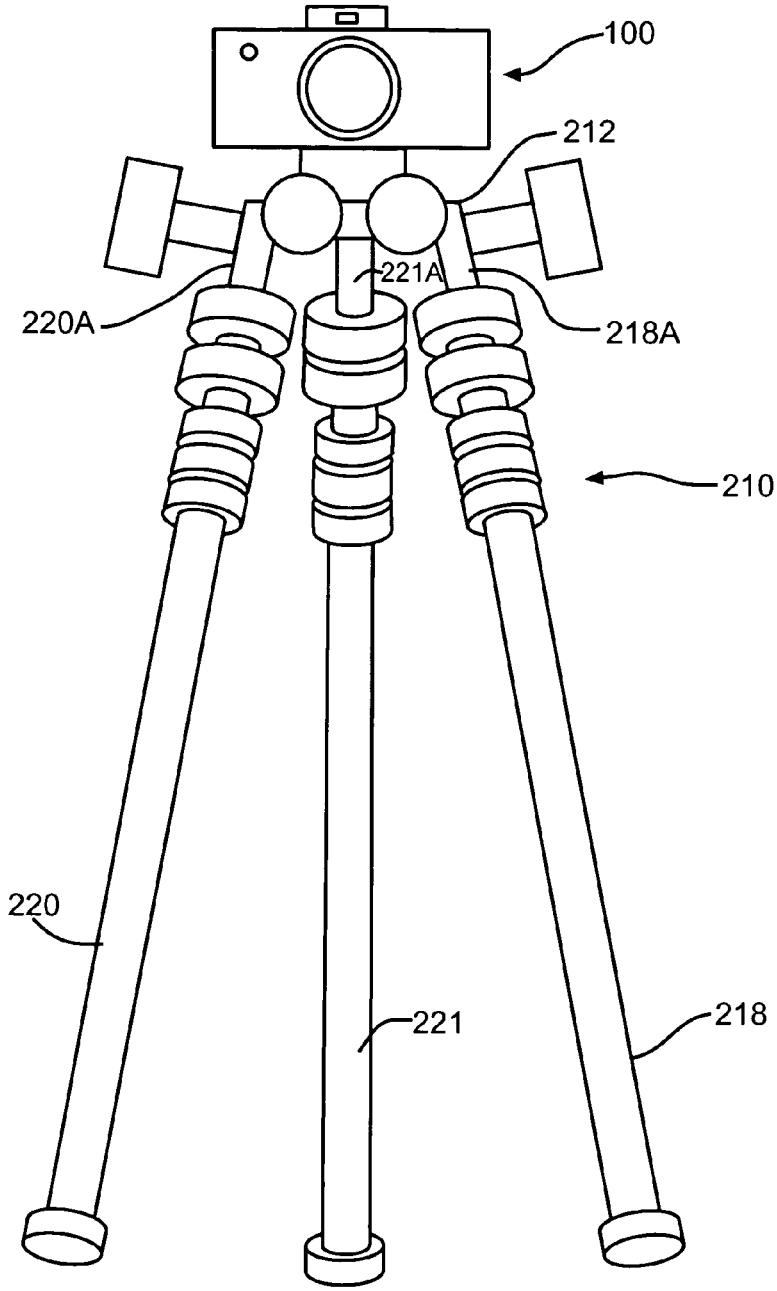
FIG. 7 is a schematic perspective view of a second embodiment of the stabilizing device 210.

The legs 18 and 20 of the stabilizing device 10 have a first end 18A and 20A and a second end 18B and 20B forming a longitudinal axis B—B and C—C of the legs 18 and 20. In one (1) embodiment, the stabilizing device 10 is a bipod and has a pair of legs 18 and 20. The legs 18 and 20 are preferably identical and therefore, only one of the legs 20 will be discussed in detail. The first end 20A of the leg 20 is connected to the object bracket 12. In one (1) embodiment, the leg 20 is fixably mounted to the object bracket 12. In another embodiment, the first end 20A of the leg 20 is pivotably mounted at the first end 20A to the bracket 12 so that the leg 20 can be folded essentially 90° for storage (FIG. 6). In this embodiment, the leg 20 is locked into a fixed, extended position for use with the stabilizing device 10. In one (1) embodiment, the first end 20A of the leg 20 is provided with a spring activated pin 22. To move the leg 20 from the folded, storage position to the extended, use position, the user pulls on the pin 22 which pulls the pin 22 out of a first hole 24 in the bracket 12. The user then rotates the leg 20. When the leg 20 is in the fully, extended position, the pin 22 is aligned with a second hole 26 in the bracket 12 so that the pin 22 automatically extends into the second hole 26 due to the spring and locks the leg 20 in the extended position (FIG. 6). In one (1) embodiment, the first ends 18A and 20A of the legs 18 and 20 are fixably connected to the bottom side of the object bracket 12. In another embodiment, where the object bracket 12 has legs 12A and 12B connected by a center section 12C, the legs 18 and 20 of the stabilizing device 10 are connected to the outer surface of the legs 12A and 12B of the bracket 12. In one (1) embodiment, the pivot point for the legs 18 and 20 is adjacent a bottom edge of the legs 12A and 12B of the object bracket 12 spaced apart from the center section 12C of the object bracket 12. The legs 18 and 20 are mounted to the object bracket 12 so that in use, the legs 18 and 20 are spaced apart at an angle. In one (1) embodiment, the angle between the longitudinal axes B—B and C—C of the legs 18 and 20 is approximately 60°. In an alternate embodiment, the stabilizing device 210 is a tripod and has three (3) legs 218, 220 and 221 connected at the first end 218A, 220A and 221A to the object bracket 212 (FIG. 7). In this embodiment, the legs 218, 220 and 221 are spaced apart equally about a vertical axis or vertical center of the object bracket 212. In another alternate embodiment (not shown), the stabilizing device includes only a single leg. In this embodiment, the single leg is coaxial with the vertical axis or vertical center of the object bracket.

The legs 18, 20, 218, 220 and 221 are constructed to form an anti-vibration or stabilizing system. In one (1) embodiment, the legs 18 and 20 have a core 28 or center rod extending between the ends 18A, 20A, 18B and 20B with damping material 30 positioned around the core 28. In one (1) embodiment, the core 28 is constructed of several sections connected together to form a single piece. The core 28 can also be constructed as a single unitary piece. The core 28, in one (1) embodiment, is rigid and constructed of a strong, non-flexible material such as steel. In one (1) embodiment, the core 28 is securely and fixably connected to the object bracket 12. The core 28 can also be removably connected to the object bracket 12. In still another embodiment, the core 28 connects to a mounting block 32 which is fixably or pivotably connected to the object bracket 12. The length of the legs 18 and 20 can be adjusted depending on the type of object 100 to be used with the stabilizing device 10. The length of the legs 18 and 20 may also be adjusted depending on the weight of the object 100. In one (1) embodiment, the legs 18 and 20 are constructed of a plurality of damping units or sections 34 which are connected together. It is understood that the number and type of damping units 34 used to form the legs 18 and 20 depends on the object 100 and the type of vibration which is to be decreased. In one (1) embodiment, a series of damping sections or units 34 similar to those manufactured by Sims, Inc. and described in U.S. Patent Application Publication No. US 2002/0088448 A1 are connected together to form the legs 18 and 20. The damping units 34 can be constructed such as to have different damping characteristics so as to reduce or eliminate vibrations having different frequencies. In one (1) embodiment, the damping units 34 having different damping characteristics can be interchanged to enable reduction or elimination of vibrations having specific characteristics. In one (1) embodiment, for an object 100 weighing approximately 10 lbs., the legs 18 and 20 have a length of approximately 9.0 inches (23 cm). In one (1) embodiment, using the damping units 34 for an object 100 weighing approximately 10 lbs., the legs 18 and 20 have a length of approximately 11.0 inches (28 cm) between the ends 18A, 20A, 18B and 20B and are constructed of one (1) Enhancer 2000™ by Sims, Inc. at the first end 18A and 20A and three (3) damping units 34 by Sims, Inc. extending outward from the Enhancer 2000™ to the second end 18B and 20B. In this embodiment, an outer damping ring can be mounted on the stem of the Enhancer 2000™ adjacent the first end 18A and 20A of the legs 18 and 20. In one (1) embodiment using the Sims, Inc. modules, three (3) of the damping units 34 have an outer diameter of 1.5 inches (3.8 cm) and two (2) of the damping units 34 have an outer diameter of approximately 2.25 inches (5.72 cm).

Feet 35 are mounted at the second end 18B and 20B of each leg 18 and 20. The feet 35 enable the stabilizing device 10 to be positioned on a variety of surfaces. In one (1) embodiment, the feet 35 are constructed of damping material. The feet 35 can be constructed of rubber or any well known damping material. In one (1) embodiment, the feet 35 are constructed such as to grab the surface such as by friction to reduce the movement of the stabilizing device 10 on the surface. In one (1) embodiment, the feet 35 are similar to the Stabilizer Enhancer™ marketed by Sims, Inc.

Figure 2A:
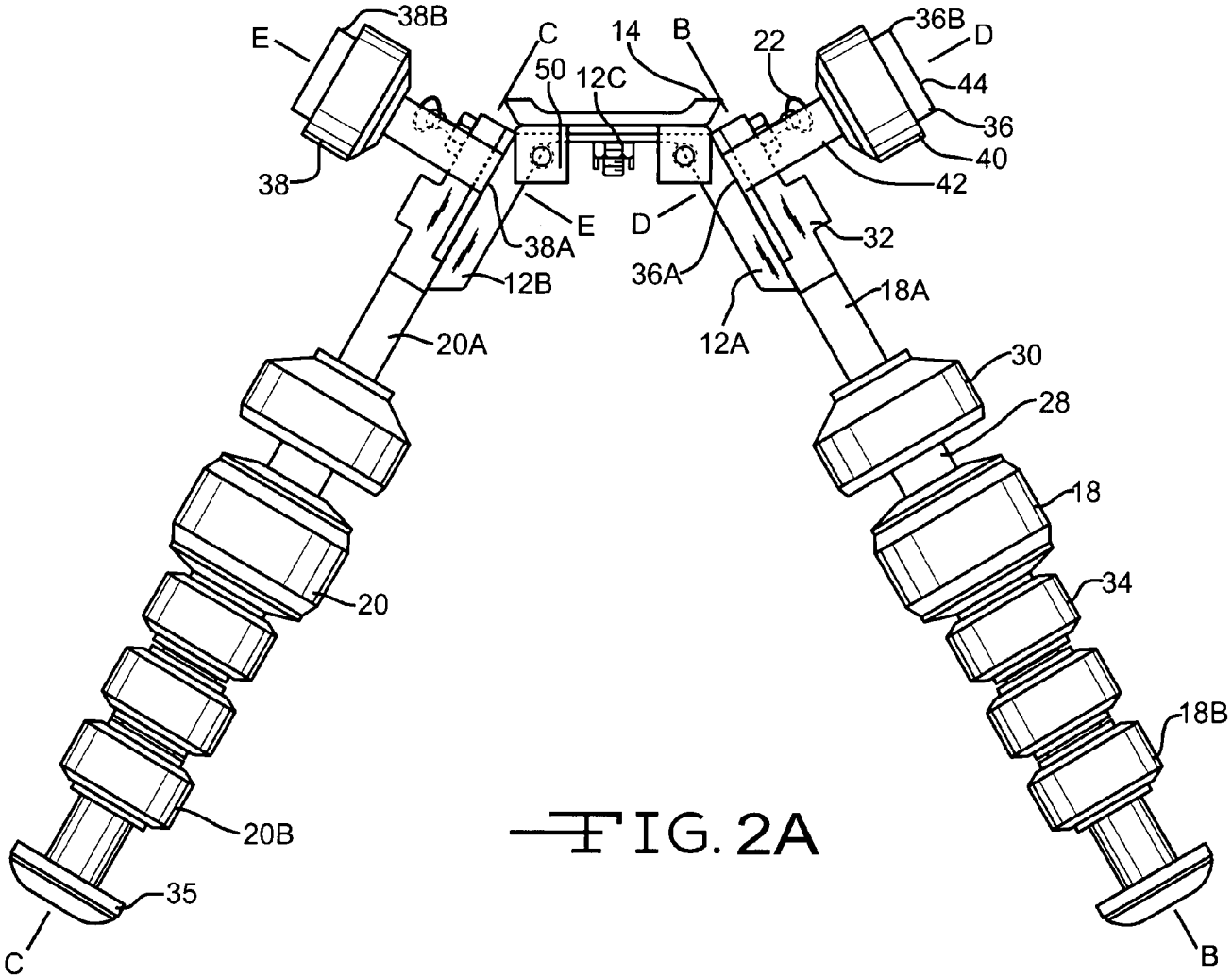
FIG. 2A is a front view of the stabilizing device 10 with the forward arms 46 and 48 removed for clarity.

The side arms 36 and 38 of the stabilizing device 10 have a first end 36A and 38A and a second end 36B and 38B forming a longitudinal axis D—D and E—E of the side arms 36 and 38. The side arms 36 and 38 are mounted at the first end 36A and 38A on the object bracket 12. Each of the side arms 36 and 38 is mounted at an angle of approximately 90° to one of the legs 18 or 20 so that the longitudinal axis B—B or C—C of one of the legs 18 or 20 is essentially perpendicular to the longitudinal axis D—D or E—E of one of the side arms 36 or 38 (FIGS. 2 and 2A). In one (1) embodiment where the object bracket 12 has legs 12A and 12B connected by a center section 12C, the side arms 36 and 38 are connected to the outer surface of the legs 12A and 12B of the bracket 12. In one (1) embodiment, the side arms 36 and 38 are positioned so that when the legs 18 and 20 are moved from the folded position to the extended, use position, the legs 18 or 20 contact the side arms 36 and 38 when the legs 18 and 20 are in the fully extended position and the pin 22 is aligned with the second hole 26 in the object bracket 12. Similarly in one (1) embodiment, the side arms 36 and 38 are positioned so that when the legs 18 and 20 are moved from the extended position to the folded position, the legs 18 and 20 contact the side arms 36 and 38 when the legs 18 and 29 are in the folded position and the pin 22 is aligned with the first hole 24 in the object bracket 12 (FIG. 6). In these embodiments, the positioning of the side arms 36 and 38 allow for easier locking of the legs 18 and 20 in the folded and extended positions by aligning the pin 22 with the locking holes 24 and 26. In one (1) embodiment, the side arms 36 and 38 are shorter in length than the legs 18 and 20. In this one (1) embodiment, the side arms 36 and 38 have a rigid core 42 or center rod surrounded by damping material 44. In one (1) embodiment, the side arms 36 and 38 are constructed of damping sections or units 40 similar to the damping units 34 used for the legs 18 and 20. The side arms 36 and 38 can be constructed of a single damping section 40. In this embodiment, the damping section 40 is mounted adjacent the second end 36B and 38B of the arms 36 and 38 spaced apart from the object bracket 12. In this embodiment, the core 42 of the damping section 40 is coaxial with or parallel to the longitudinal axis D—D or E—E of the arm 36 or 38. In one (1) embodiment, the damping section 40 is similar to damping modules manufactured by Sims, Inc., as described in U.S. Patent Application Publication No. 2002/0088448 A1. It is understood that the length of the side arms 36 and 38 and the type, size and number of damping units 40 used to construct the side arms 36 and 38 may be varied to compensate for different amounts or types of vibration or to compensate for the object 100 having a different weight or size.

The front arms 46 and 48 of the stabilizing device 10 have a first end 46A and 48A and a second end 46B and 48B forming longitudinal axes F—F and G—G of the front arms 46 and 48. The first ends 46A and 48A of the front arms 46 and 48 are mounted on the object bracket 12. In one (1) embodiment, the first ends 46A and 48A of the front arms 46 and 48 are connected to blocks 50 on the bottom side of the object bracket 12 (FIG. 2A). In this embodiment, the longitudinal axes F—F and G—G of the front arms 46 and 48 are parallel to the longitudinal axis A—A of the object 100. In one (1) embodiment, where the object bracket 12 has a pivotable top plate 14, the front arms 46 and 48 are connected to the stationary object bracket 12. In the embodiment where the object bracket 12 has a center section 12C and two (2) angled legs 12A and 12B, the front arms 46 and 48 are connected to the center section 12C. The first ends 46A and 48A of the front arms 46 and 48 are fixably mounted on the object bracket 12. In one (1) embodiment, the stabilizing device 10 has a single forward arm. In this embodiment, the front arm is preferably mounted in the front, center of the object bracket 12. In one (1) embodiment, each of the front arms 46 and 48 extends outward from the front of the object bracket 12 at an angle of approximately 80° to one of the legs 18 and 20 and at an angle of approximately 90° to one of the side arms 36 and 38. In one (1) embodiment, the longitudinal axes F—F or G—G of one of the front arms 46 or 48 is essentially perpendicular to the longitudinal axes B—B or C—C of one of the legs 18 or 20 and is essentially perpendicular to the longitudinal axes D—D or E—E of one of the side arms 36 or 38. In one (1) embodiment, the first ends 46A and 48A of the front arms 46 and 48 extend below the object bracket 12 such as to be adjacent the bottom side of the object bracket 12 and adjacent the first ends 18A and 20A, 36A and 38A of the legs 18 and 20 and of the side arms 36 and 38. In one (1) embodiment, the front arms 46 and 48 are angled downward away from the top side of the object bracket 12 so that the front arms 46 and 48 do not interfere with the object 100 positioned on the top side of the object bracket 12. In one (1) embodiment, the object 100 is a firearm and the front arms 46 and 48 are angled slightly downward so that the outer, damping material does not contact the barrel of the firearm 100. In one (1) embodiment, the front arms 46 and 48 have a core or center rod 49 adjacent the first end 46A and 48A which is connected to a damping unit 52 at the second end 46B and 48B. Thus, the damping unit 52 is spaced apart from and in front of the front end of the object bracket 12. The center rod 49 of each of the front arms 46 and 48 are fixably mounted on the object bracket 12. In one (1) embodiment, the front arms 46 and 48 are shorter than the legs 18 and 20. In one (1) embodiment, the damping units 52 of the front arms 46 and 48 are similar to the DOINKER CHUBBY HUNTER™ manufactured by Doinker. It is understood that other types of damping units could also be used. The front arms 46 and 48 could also be constructed of center rods 49 having damping material mounted on the center rod 49 between the ends of the center rod 49.

The stabilizing device 10 of the present invention is intended to reduce the vibration in an object 100 to enable more accurate operation of the object 100. In one (1) embodiment, the stabilizing device 10 is intended to be used to stabilize a rifle having a sight while the user is in an airplane, helicopter, boat or any other non-stable platform. In one (1) embodiment, the object 100 is a firearm such as a rifle. In this embodiment, to use the stabilizing device 10, the stock of the firearm is connected to the object bracket 12 so that the barrel of the firearm extends outward from the front of the object bracket 12 in a direction similar to the front arms 46 and 48. In another embodiment, the object 100 is a camera with the user attempting to take photographs from a moving airplane, helicopter, boat or any other non-stable platform (FIG. 7). Once the object 100 is connected to the object bracket 12, legs 18 and 20 of the stabilizing device 10 are positioned on the surface. In one (1) embodiment where the legs 18 and 20 are collapsible, the legs 18 and 20 are moved and locked into the extended position before the stabilizing device 10 is positioned on the surface. The legs 18 and 20 are positioned so that the object 100 is pointing essentially in the direction of the target. The use of the pivoting top plate 14 with the object bracket 12 allows for more versatility in positioning of the object bracket 12, since the object 100 can be pivoted about a vertical axis after the stabilizing device 10 is in position. In addition, the feet 35 help to secure the legs 18 and 20 to the surface during movement and positioning of the object 100 due to friction between the feet 35 and the surface. Once the stabilizing device 10 is in position, the user can aim the object 100 at the target. Where the stabilizing device 10 has only two (2) legs 18 and 20, the user is able to pivot the firearm to raise or lower the sight of the object 100. In the embodiment having only one (1) leg 18, the user is able to pivot and rotate the object 100 in a variety of different directions. The embodiment having three (3) legs allows for less movement but more stability in handling and positioning the object 100. Once the object 100 is in position, the user can aim at the target and shoot at the target.

The stabilizing device 10 allows for removal of vibration in all directions from the object bracket 12 and the object 100.

The mounting of the legs 18 and 20, side arms 36 and 38 and front arms 46 and 48 at angles of approximately 90° to each other allows for forces in all directions to be transferred away from the object bracket 12 and the object 100 and to the legs 18 and 20, side arms 36 and 38 and front arms 46 and 48. The front arm or arms 46 and 48 reduce the vibrations in the object bracket 12 parallel to the longitudinal axis A—A of the object 100. Thus, when the object 100 is a firearm, the front arm or arms 46 and 48 reduce or eliminate vibrations parallel to the barrel of the firearm. The side arms 36 and 38 are positioned at 90° to the front arms 46 and 48 and at 90° to the legs 18 and 20. The side arms 36 and 38 reduce or eliminate vibrations perpendicular to the longitudinal axis A—A of the object bracket 12 and the object 100. The legs 18 and 20 are also at 90° to the longitudinal axis A—A of the object bracket 12 and the object 100 and reduce or eliminate vibrations perpendicular to the longitudinal axis A—A of the object bracket 12 and the object 100. In one (1) embodiment, the stabilizing device 10 prevents vibrations from being transferred from the vibrating surface to the object bracket 12 and finally to the object 100. Vibration from the vibrating surface is transferred to the core 28 of the legs 18 and 20 of the stabilizing device 10. The damping material 30 reduces the vibration transferred to the object bracket 12. The damping material 30 dampens the vibrations of the core 28 before the vibrations can be transferred from the surface to the object bracket 12 and the object 100. Vibrations which reach the object bracket 12 are transferred from the object bracket 12 to the cores 28 and 42 or center rods 49 of the legs 18 and 20, side arms 36 and 38 and front arms 46 and 48 which are fixably mounted to the object bracket 12. The damping material 30 and 44 of the legs 18 and 20, side arms 36 and 38 and front arms 46 and 48 then removes or reduces the vibration from the cores 28 and 42 or center rods 49 to prevent transfer of the vibration back to the object bracket 12 and the object 100. In addition, the contact of the legs 18 and 20 with the surface reduce the transference of vibration from the vibrating surface to the object bracket 12 and the object 100. In one (1) embodiment, the stabilizing device 10 removes or reduces the vibrations in the object 100 resulting from operation of the object 100. The vibrations in the object 100 are transferred to the object bracket 12 and then to the cores 28 and 42 and center rods 49 of the legs 18 and 20, side arms 36 and 38 and front arms 46 and 48 of the stabilizing device 10. The damping material 30 and 44 of the legs 18 and 20, side arms 36 and 38 and front arms 46 and 48 eliminate or reduce the vibration and prevent the vibration from moving back to the object bracket 12 or the object 100. Reducing the vibration enables the shooter to align the firearm with the target quickly and to easily hold the alignment when shooting. In the embodiment where the object 100 is a firearm, the stabilizing device 10 removes or reduces the vibration of the firearm caused by firing the firearm. Reducing or eliminating the vibration during shooting helps to keep the firearm aligned with the target during shooting thus, resulting in a more accurate shot. In one (1) embodiment, where the legs 18 and 20 are constructed of separate damping units 34, the damping units 34 can be removed and replaced with damping units 34 having different damping characteristics. This enables the stabilizing device 10 to be easily modified to accommodate a specific type of object 100 or to be modified to eliminate or reduce a specific type of vibration. In one (1) embodiment, the damping units 34 are threaded together and are easily interchangeable.

It is intended that the foregoing description be only illustrative of the present invention and that the present invention be limited only by the hereinafter appended claims.

We claim:

1. A stabilizing device for damping vibrations in an object positioned on a surface, which comprises:

(a) a bracket configured to connect to the object;

(b) legs, each leg having a first end and a second end with first damping material between the ends and connected at the first end to the bracket; and (c) side arms each having a first end and a second end and connected at the first end to the bracket and having second damping material positioned on each side arm and not directly connected to the bracket wherein the second damping material is configured to reduce vibrations in the bracket.

2. The device of claim 1 wherein a forward arm having a first end and a second end forming a longitudinal axis of the forward arm is connected at the first end to the bracket, the forward arm having third damping material positioned along the longitudinal axis of the forward arm to reduce vibrations in the bracket.

3. The device of claim 2 wherein the ends of each leg form a longitudinal axis of each leg and wherein the longitudinal axis of one of the legs is at an angle of approximately 90° to the longitudinal axis of the forward arm.

4. The device of claim 2 wherein the longitudinal axis of the forward arm is parallel to a longitudinal axis of the object when the object is connected to the bracket.

5. The device of claim 2 wherein the third damping material is spaced apart from the first end of the forward arm.

6. The device of claim 2 wherein the forward arm is connected to the bracket so that when the object is connected to the bracket, the forward arm extends outward from the bracket along the object.

7. The device of claim 1 wherein the ends of each leg form a longitudinal axis of each leg and the ends of each side arm form a longitudinal axis of each side arm and wherein the longitudinal axis of one of the legs is at an angle of approximately 90° to the longitudinal axis of one of the side arms.

8. The device of claim 1 or 2 wherein a plate is pivotably connected to the bracket and wherein the legs are connected to the bracket and the object is connected to the plate so that the object can be pivoted while the legs remain stationary.

9. The device of claim 8 wherein the forward arm is connected to the plate.

10. The device of claim 1 or 2 wherein the bracket includes a first leg and a second leg connected together at an angle by a center portion, and wherein one of the legs is connected to the first leg of the bracket and the other of the legs is connected to the second leg of the bracket.

11. The device of claim 10 wherein one of the side arms is connected to the first leg of the bracket and the other of the side arms is connected to the second leg of the bracket.

12. The device of claim 1 or 2 wherein the first damping material includes a plurality of separable damping units.

13. The device of claim 12 wherein at least two of the separable damping units are constructed of damping material having different damping characteristics for damping different vibration frequencies.

14. The device of claim 1 wherein the second damping material is spaced apart from the first ends of the side arms.

15. The device of claim 1 wherein the first damping material is positioned on the legs to reduce vibrations in the bracket in a first direction and wherein the second damping material reduces vibration in the bracket in a second direction different from the first direction.

16. A stabilizing device for damping vibrations in a firearm positioned on a surface, which comprises:

(a) a bracket configured to connect to the firearm;

(b) legs, each leg having a first end and a second end with first damping material between the ends and connected at the first end to the bracket; and (c) side arms each having a first end and a second end and connected at the first end to the bracket with second damping material positioned on each side arm and not directly connected to the bracket wherein the second damping material is configured to reduce vibrations in the bracket.

17. The device of claim 16 wherein the ends of each leg form a longitudinal axis of each leg and the ends of each side arm form a longitudinal axis of each side arm and wherein the longitudinal axis of one of the legs is at an angle of approximately 90° to the longitudinal axis of one of the side arms.

18. The device of claim 16 wherein the legs are pivotably connected to the bracket.

19. The device of claim 16 wherein a plate is pivotably connected to the bracket and wherein the firearm is connected to the plate so that the firearm can be pivoted while the legs remain stationary.

20. The device of claim 16 wherein the second damping material is spaced apart from the first ends of the side arms.

21. The device of claim 16 wherein the bracket includes a first leg and a second leg connected together at an angle by a center portion, and wherein one of the legs is connected to the first leg of the bracket and the other of the legs is connected to the second leg of the bracket.

22. The device of claim 21 wherein one of the side arms is connected to the first leg of the bracket and the other of the side arms is connected to the second leg of the bracket.

23. The device of claim 16 wherein the first damping material includes a plurality of separable damping units.

24. The device of claim 23 wherein at least two of the separable damping units are constructed of damping material having different damping characteristics for damping different vibration frequencies.

25. The device of claim 16 wherein the second ends of the legs are provided with feet constructed of a third damping material.

26. The device of claim 16 wherein there are three legs spaced apart approximately 60° about a vertical axis of the bracket.

27. A stabilizing device for damping vibrations in a firearm positioned on a surface, which comprises:

(a) a bracket configured to connect to the firearm;

(b) legs, each leg having a first end and a second end with the first end of each leg connected to the bracket, each leg having first damping material between the ends; and (c) a forward arm having a first end and a second end forming a longitudinal axis of the forward arm with the first end of the forward arm connected to the bracket and having second damping material positioned on the forward arm spaced apart from the firearm and configured to reduce vibrations in the bracket.

28. The device of claim 27 wherein the ends of each leg form a longitudinal axis of each leg and wherein the longitudinal axis of one of the legs is at an angle of approximately 90° to the longitudinal axis of the forward arm.

29. The device of claim 28 wherein the legs are pivotably connected to the bracket.

30. The device of claim 27 wherein the bracket includes a plate pivotably connected to a bracket section wherein the legs are connected to the bracket section of the bracket and the firearm is connected to the plate of the bracket so that the firearm can be pivoted while the legs remain stationary.

31. The device of claim 30 wherein the forward arm is connected to the plate.

32. The device of claim 27 wherein the longitudinal axis of the forward arm is parallel to a longitudinal axis of a barrel of the firearm when the firearm is mounted on the bracket.

33. The device of claim 27 wherein the second damping material is spaced apart from the first end of the forward arm.

34. The device of claim 27 wherein the bracket includes a first leg and a second leg connected together at an angle by a center portion, wherein the forward arm is mounted on the center portion of the bracket and wherein one of the legs is connected to the first leg of the bracket and the other one of the legs is connected to the second leg of the bracket.

35. The device of claim 27 wherein the forward arm is connected to the bracket so that when the firearm is connected to the bracket, the forward arm extends outward from the bracket along a barrel of the firearm in a direction opposite a stock of the firearm.

36. The device of claim 27 wherein the first damping material includes a plurality of separable sections.

37. The device of claim 36 wherein each leg has at least two separable sections and wherein at least two of the sections are constructed of leg damping material having different damping characteristics for damping different vibration frequencies.

38. The device of claim 27 wherein the second ends of the legs are provided with feet constructed of a third damping material.

39. The device of claim 27 wherein there are three legs spaced apart approximately 60° about a vertical axis of the bracket.

40. A stabilizing device for damping vibrations in a firearm positioned on a surface, which comprises:

(a) a bracket configured to connect to the firearm;

(b) legs, each leg having a first end and a second end and connected at the first end to the bracket, and configured so that the second end of each leg contacts the surface, each leg having first damping material;

(c) side arms, each arm having a first end and a second end and connected at the first end to the bracket, each side arm having second damping material positioned to reduce vibrations in the bracket; and (d) a forward arm having a first end and a second end and connected at the first end to the bracket and having third damping material positioned on the forward arm spaced apart from the firearm and configured to reduce vibrations in the bracket.

41. The device of claim 40 wherein there are three legs spaced apart approximately 60° about a vertical axis of the bracket.

42. The device of claim 40 wherein the ends of each leg form a longitudinal axis of each leg and the ends of each side arm form a longitudinal axis of each side arm and wherein the longitudinal axis of one of the legs is at an angle of approximately 90° to the longitudinal axis of one of the side arms.

43. The device of claim 40 wherein the ends of each leg form a longitudinal axis of each leg and wherein the longitudinal axis of one of the legs is at an angle of approximately 90° to the longitudinal axis of the forward arm.

44. The device of claim 40 wherein the ends of each leg form a longitudinal axis of each leg and the ends of each side arm form a longitudinal axis of each side arm and the ends of the forward arm form a longitudinal axis of the forward arm and wherein the longitudinal axis of one of the legs is approximately at a 90° angle to the longitudinal axis of one of the side arms and approximately at an 80° angle to the longitudinal axis of the forward arm.

45. The device of claim 40 wherein the legs are pivotably connected to the bracket.

46. The device of claim 40 wherein the bracket includes a plate pivotably connected to a bracket section, and wherein the legs are connected to the bracket section of the bracket and the firearm is connected to the plate so that the firearm can be pivoted while the legs remain stationary.

47. The device of claim 46 wherein the forward arm is connected to the plate.

48. The device of claim 46 wherein the side arms are connected to the bracket section.

49. The device of claim 40 wherein the longitudinal axis of the forward arm is parallel to a longitudinal axis of a barrel of the firearm when the firearm is mounted on the bracket.

50. The device of claim 40 wherein the second damping material is spaced apart from the first end of the side arms.

51. The device of claim 40 wherein the third damping material is spaced apart from the first end of the forward arm.

52. The device of claim 40 wherein the bracket includes a first leg and a second leg connected together at an angle by a center portion, wherein the forward arm is mounted on the center portion of the bracket and wherein each of the legs and each of the side arms is connected to the first and second legs of the bracket.

53. The device of claim 40 wherein the forward arm is connected to the bracket so that when the firearm is mounted on the bracket, the forward arm extends outward from the bracket along a barrel of the firearm in a direction opposite a stock of the firearm.

54. The device of claim 40 wherein the first damping material includes a plurality of separable sections.

55. The device of claim 54 wherein each leg has at least two separable sections and wherein at least two of the sections are constructed of damping material having different damping characteristics for damping different vibration frequencies.

56. The device of claim 40 wherein there are a plurality of forward arms and wherein the forward arms are spaced apart and parallel.

57. A stabilizing device for damping vibrations in a firearm positioned on a surface, which comprises:

(a) a bracket configured to connect to the firearm;

(b) a leg having a first end and a second end forming a longitudinal axis of the leg with the first end of the leg connected to a center of the bracket;

(c) first damping material positioned on the leg to reduce vibration in the bracket;

(d) side arms, each side arm having a first end and a second end with the first end of each side arm connected to the bracket;

(e) second damping material positioned on each side arm and configured to reduce vibration in the bracket;

(f) a forward arm having a first end and a second end and connected at the first end to the bracket; and (g) third damping material positioned on the forward arm spaced apart from the firearm and configured to reduce vibration in the bracket.

* * * * *